US010001273B2

(12) United States Patent
Wang

(10) Patent No.: US 10,001,273 B2
(45) Date of Patent: Jun. 19, 2018

(54) ROTARY FLAME HEATER

(71) Applicant: Pengyu Wang, Changzhou (CN)

(72) Inventor: Pengyu Wang, Changzhou (CN)

( * ) Notice: Subject to any disclaimer, the term of this patent is extended or adjusted under 35 U.S.C. 154(b) by 261 days.

(21) Appl. No.: 15/007,231

(22) Filed: Jan. 27, 2016

(65) Prior Publication Data

US 2017/0167724 A1 Jun. 15, 2017

(30) Foreign Application Priority Data

Dec. 9, 2015 (CN) ..... 2015 1 0908320
Dec. 9, 2015 (CN) ..... 2015 2 1015473 U

(51) Int. Cl.

| | |
|---|---|
| ***F23D 14/12*** | (2006.01) |
| ***F23D 14/70*** | (2006.01) |
| ***F24D 19/06*** | (2006.01) |
| ***F23D 14/84*** | (2006.01) |

(52) U.S. Cl.

CPC ..... *F23D 14/70* (2013.01); *F23D 14/12* (2013.01); *F23D 14/84* (2013.01); *F24D 19/06* (2013.01)

(58) Field of Classification Search

CPC ..... F23D 14/70
USPC ..... 431/353, 355
See application file for complete search history.

(56) References Cited

U.S. PATENT DOCUMENTS

| | | | | |
|---|---|---|---|---|
| 3,796,209 A * | 3/1974 | Luft | ..... | A01G 13/06 126/59.5 |
| 2010/0154779 A1* | 6/2010 | Andors | ..... | A47B 37/04 126/512 |
| 2013/0252188 A1* | 9/2013 | Chen | ..... | F23D 14/06 431/353 |

FOREIGN PATENT DOCUMENTS

| | | | |
|---|---|---|---|
| CN | 202083027 | U | 12/2011 |
| CN | 202852970 | U | 4/2013 |
| CN | 203147831 | U | 8/2013 |
| CN | 204043050 | U | 12/2014 |
| CN | 204043050 | U | 12/2014 |
| CN | 104296231 | A | 1/2015 |
| CN | 104848352 | A | 8/2015 |
| CN | 205279229 | U | 6/2016 |
| EP | 2098781 | A2 | 9/2009 |

* cited by examiner

*Primary Examiner* — Avinash Savani
(74) *Attorney, Agent, or Firm* — Gokalp Bayramoglu

(57) ABSTRACT

This invention relates to a rotary flame heater, comprising a burner, a first wind wheel, a second wind wheel and a glass tube set in sequence from bottom to top; one side of the burner is set with an ignition device, the first wind wheel and second wind wheel are annular, a plurality of first air inlet passages are aslant set on a side wall of the first wind wheel, a plurality of second air inlet passages are aslant set a side wall of the second wind wheel, the inclined direction of the plurality of first air inlet passages is the same with that of the second air inlet passages. The advantage of this invention is to make full use of the combustion space, increase the contacting area with the glass tube and increase the calorific value when burns the same gas, which achieves a better heating effect.

9 Claims, 6 Drawing Sheets

ROTARY FLAME HEATER

TECHNICAL FIELD OF THE INVENTION

This invention relates to field of heater, in particular relates to a rotary flame heater.

BACKGROUND

About existing glass tube heater on the market, no matter what diameter of the glass tube it is, the flame all burns vertically with a same ornamental effect, as a result the flame does not make a full use of the combustion space in the internal of the glass tube. The flame as a whole is vertically upward and does not contact with the glass tube directly.

Under such circumstances, because the diameter of the flame only occupies part of the diameter of the glass tube, the flame is unable to hit the inner wall of the glass tube directly. As a result, the inner wall of the glass tube cannot be heated adequately, and the glass tube is unable to dissipate heat well, which fails to achieve the purpose of heating. Furthermore, the shape of the flame of the heater is dull and rigid.

Existing solutions such as patent App. No. 201410377119.0 and patent App. No. 201420433026.0 relate to a semicircle shaped glass tube and a supporter. The solution may make a rotation effect theoretically. However, semicircle shaped glass tube has a high breakage ratio during manufacturing process, which is against mass production and production packaging. Furthermore, the design of the supporter will leave some holes and crevices, the flame will go out of the glass tube through the crevices during rotation. This brings potential safety hazard. The solution is also inconvenient for assembling.

SUMMARY OF THE INVENTION

The objective of the present invention is to overcome the defect that the flame goes out of the glass tube through the crevices during rotation and provide a rotary flame heater.

The technical solution in the present invention is: a rotary flame heater, comprising a burner, a first wind wheel, a second wind wheel and a glass tube which are set in sequence from bottom to top;

an ignition device is disposed on one side of the burner, both of the first wind wheel and the second wind wheel are annular, a plurality of first air inlet passages are aslant set on a sidewall of the first wind wheel, a plurality of second air inlet passages are aslant set on a sidewall of the second wind wheel, the inclined direction of the plurality of first air inlet passages is the same with that of the second air inlet passages.

Preferably, a height of the ignition device is the same with a height of the plurality of first air inlet passages, an inner diameter of the first wind wheel is less than the size of the burner, a bottom of the first wind wheel is fit with a top surface of the burner. The first wind wheel is configured to mix more air before the mixed gas contacts the air coming from the plurality of second air inlet passages, and provides a rotary path for air when air enters into the first wind wheel at the same time, and thereby provides an initial rotation power. Furthermore, rotary flame has stronger rotate speed than ordinary flame, which may extinguish a long burning fire generated by the ignition device and as a result extinguish the whole burner. As the first air inlet passage is set aslant, the inner wall of the first air inlet passage can be used to block the long burning fire, which avoids extinguishing the long burning fire.

Furthermore, a side wall of the burner is set with an air inlet pipe connected to the burner, the air inlet pipe is set with an air inlet hole. The first air inflow in the air inlet hole mixes with the fuel gas in the air inlet pipe to form a mixed gas. The mixed gas enters the burner through the air inlet pipe.

Furthermore, a size of the air inlet hole is 8 mm*20 mm. The size of existing air inlet hole is 16 mm*12 mm, in order to ensure large amount of air to support the fuel gas and to avoid carbon deposition. In the present invention, a second air inflow is needed through the second air inlet passage to provide enough rotating power, so the size of air inlet hole is decreased. The mixed gas in the burner still needs more air to mix for sufficient burning. The second air inflow in the second air inlet passage can not only make the gas burnt adequately to avoid carbon deposition, but also improve rotating power of the flame.

Specifically, the first wind wheel comprises an upper dead plate, a lower dead plate, and a plurality of first blades set between the upper dead plate and the lower dead plate, an interval between each two adjacent first blades forms a first air inlet passage;

the second wind wheel comprises an upper mounting plate, a lower mounting plate, and a plurality of second blades set between the upper mounting plate and the lower mounting plate, an interval between each two adjacent second blades forms a second air inlet passage.

Preferably, the plurality of first blades and the plurality of second blades are both arc-shaped to ensure a good rotating effect of the first air inflow and the second air inflow.

Furthermore, in order to avoid the influence on the flame by entering too much air into the first air inlet passage and the second air inlet passages, an outward of the upper dead plate is set with a first annular baffle extending to the plurality of first air inlet passages;

a second annular baffle is also set on an outward of the upper mounting plate and extended to the plurality of second air inlet passages.

Preferably, for facilitating the assembling of the glass tube, a top surface of the upper mounting plate is set with an annular limiting plate projecting from the top surface, an outer diameter of the annular limiting plate matches with an inner diameter of the glass tube, an external of the glass tube is set with a protection net. The glass tube is sleeved on an external of the annular limiting plate to fix the glass tube effectively. The protection net set on the external of the glass tube can avoid scald by contacting the glass tube.

Preferably, for facilitating the assembling of the burner, the first wind wheel and the second wind wheel, the rotary flame heater further comprises a mounting cap, the mounting cap is set with a through-hole in the center, the burner and the first wind wheel are mounted within the mounting cap, the second wind wheel is mounted on an upper end of the mounting cap, the first wind wheel, the second wind wheel and the through-hole are set co-axially, the mounting cap is set with a plurality of vents connected with external, a bottom of the mounting cap is set with a mounting cavity for mourning a fuel gas source. The fuel gas source, such as a gas cylinder, is placed within the mounting cavity, which saves much space.

Beneficial effects: this application adds a first wind wheel and a second wind wheel in the upper end of the burner, and retains the glass tube, which can make the flame to generate a rotating effect. The rotary flame can make full use of the combustion space, increase the contacting area with the glass tube and increase the calorific value when burns the same gas, which achieves a better heating effect.

BRIEF DESCRIPTION OF THE DRAWINGS

The detailed description of the invention will be illustrated below combining with the drawings and the embodiments.

Figure 1:
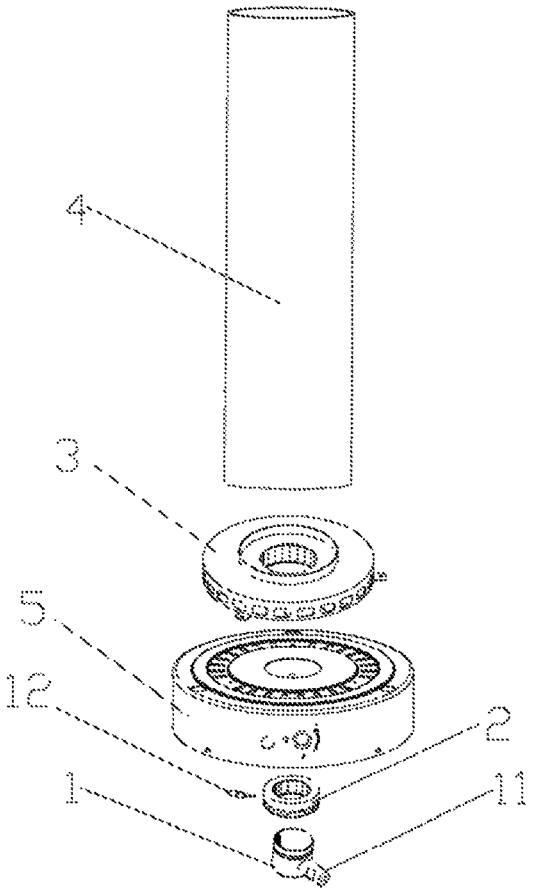
FIG. 1 is an exploded view of a heater in the present invention.

Wherein: 1. Burner; 11. Air inlet pipe; 12. Ignition device; 13. Air inlet hole; 2. First wind wheel; 21. First air inlet passage; 22. First annular baffle; 23. First blade; 24. Lower dead plate; 25. Upper dead plate; 3. Second wind wheel; 31. Second air inlet passage; 32. Annular limiting plate; 33. Second annular baffle; 34. Upper mounting plate; 35. Second blade; 36. Lower mounting plate; 4. Glass tube; 5. Mounting cap; 51. Through-hole; 52. Vent; 6. Protection net; 7. Mounting cavity.

DETAILED DESCRIPTION OF THE INVENTION

Embodiment

As shown in FIGS. 1, 5, 6, and 8-10, a rotary flame heater, comprises mounting cap 5 as well as burner 1, first wind wheel 2, second wind wheel 3 and glass tube 4 which are set in sequence from bottom to top. Mounting cap 5 is set with through-hole 51 in the center. Burner 1 and first wind wheel 2 are mounted within mounting cap 5, second wind wheel 3 is mounted on an upper end of mounting cap 5. First wind wheel 2, second wind wheel 3 and through-hole 51 are set co-axially. Mounting cap 5 is set with vent 52 which is connected with external. A bottom of mounting cap 5 is set with a mounting cavity 7 for mounting a fuel gas source.

As shown in FIGS. 1, 3, 4, 6 and 9, one side of burner 1 is set with ignition device 12. First wind wheel 2 and second wind wheel 3 are both annular. A side wall of first wind wheel 2 is aslant set with a plurality of first air inlet passages 21. A height of ignition device 12 is the same with a height of the plurality of first air inlet passages 21. An inner diameter of first wind wheel 2 is less than the size of burner 1. A bottom of first wind wheel 2 is fit with a top surface of burner 1. A side wall of second wind wheel 3 is aslant set with a plurality of second air inlet passages 31. An inclined direction of first air inlet passages 21 is the same with an inclined direction of second air inlet passages 31.

Figure 2:
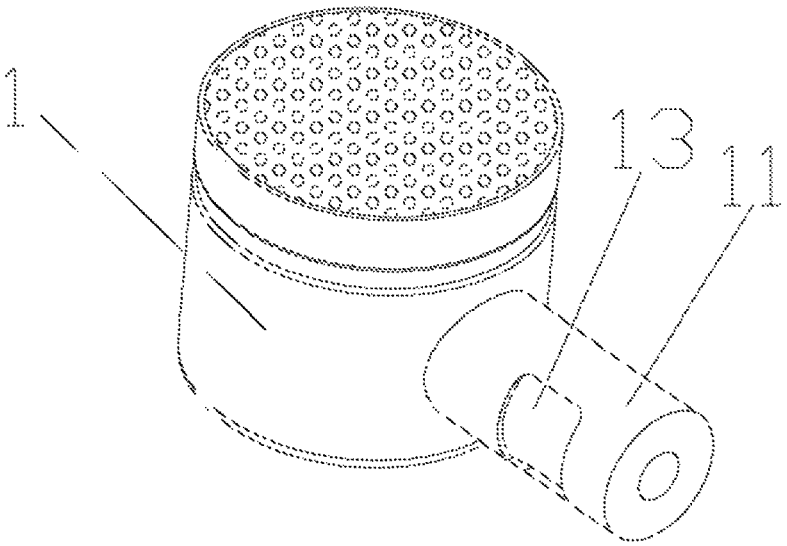
FIG. 2 is a three-dimensional structure diagram of a burner.
Figure 6:
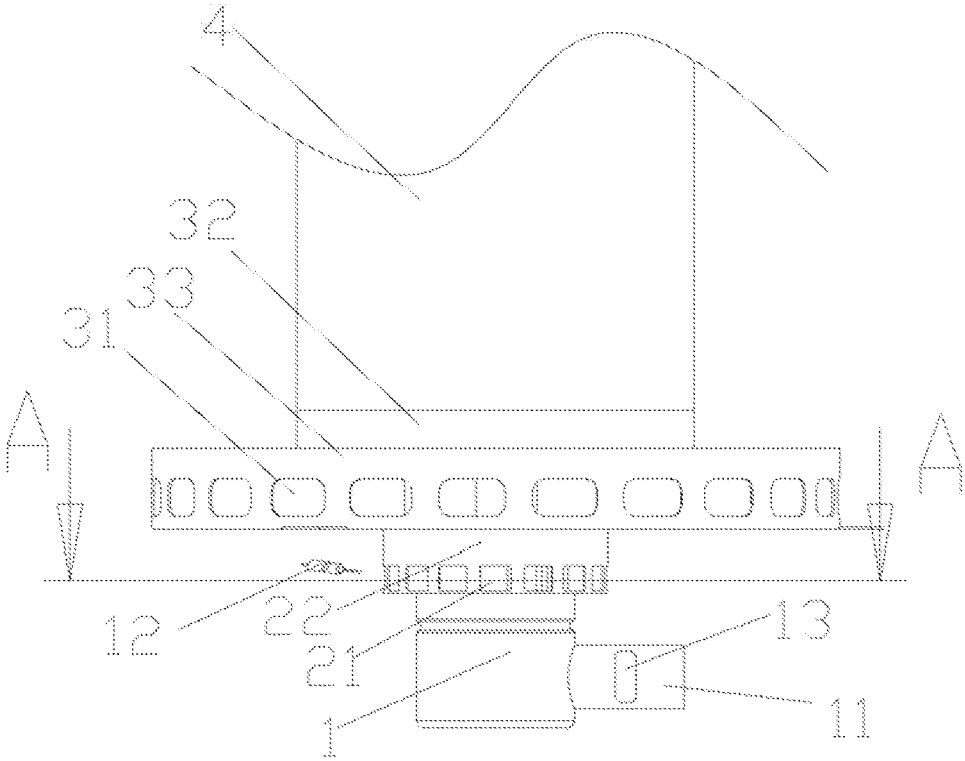
FIG. 6 is a mounting structure diagram of the heater (without the mounting cap)

As shown in FIGS. 1-2 and 6, a side wall of burner 1 is set with air inlet pipe 11 which is connected to burner 1. Air inlet pipe 11 and ignition device 12 are set oppositely. Air inlet pipe 11 is set with air inlet hole 13. The size of air inlet hole 13 is 8 mm*20 mm.

Figure 3:
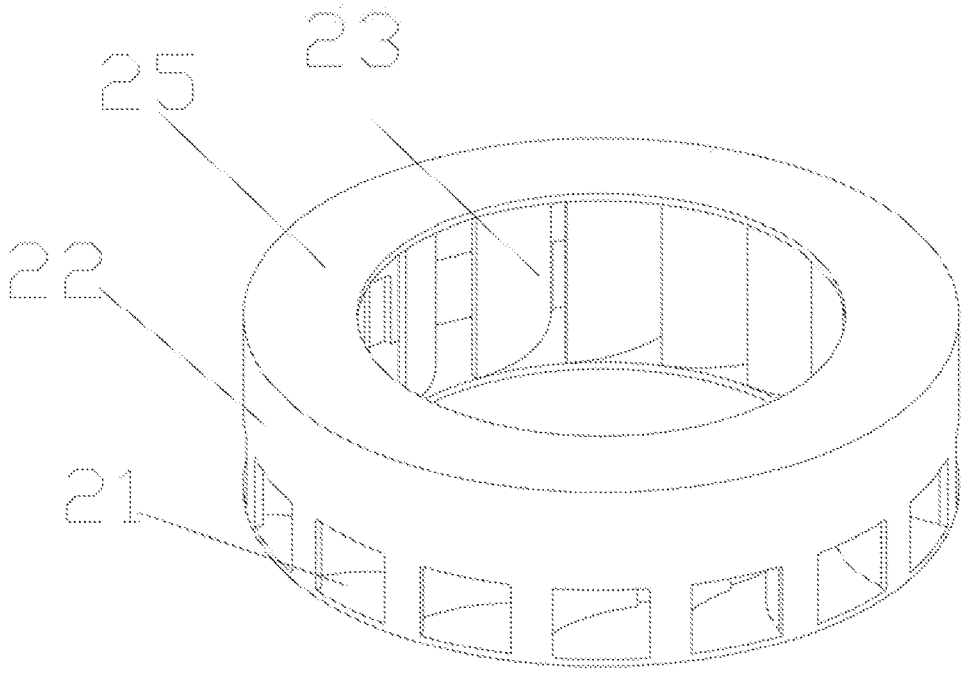
FIG. 3 is a three-dimensional structure diagram of a first wind wheel.
Figure 9:
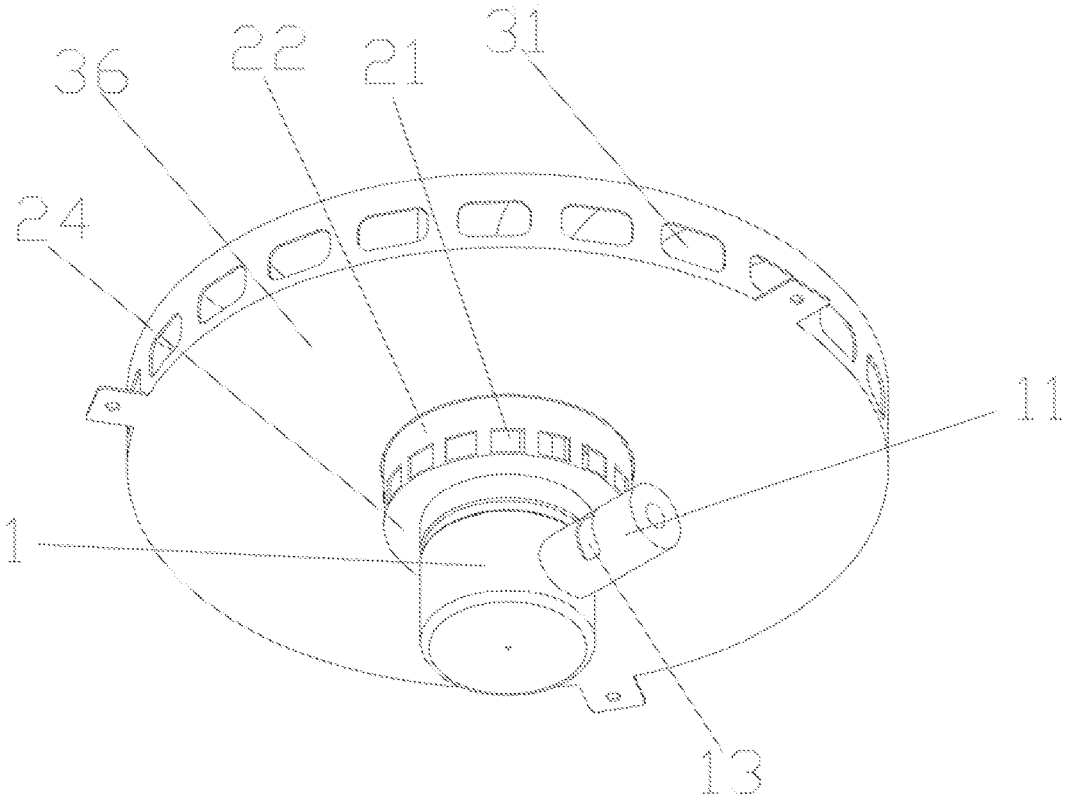
FIG. 9 is a mounting structure diagram of the heater (without the mounting cap and glass tube)

Specifically, as shown in FIGS. 3, 6 and 9, first wind wheel 2 comprises upper dead plate 25, lower dead plate 24, and a plurality of first blades 23 set between upper dead plate 25 and lower dead plate 24. An interval between each two adjacent first blades 23 forms a first air inlet passage 21. An outward of upper dead plate 25 is set with first annular baffle 72 extending to the plurality of first air inlet passages 21.

Figure 4:
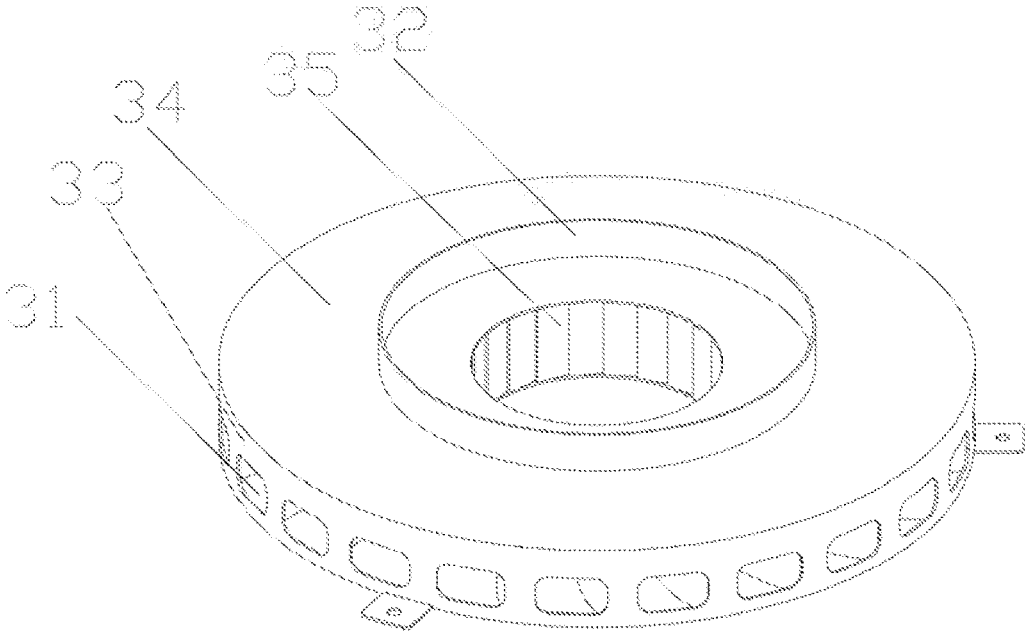
FIG. 4 is a three-dimensional structure diagram of a second wind wheel.
Figure 5:
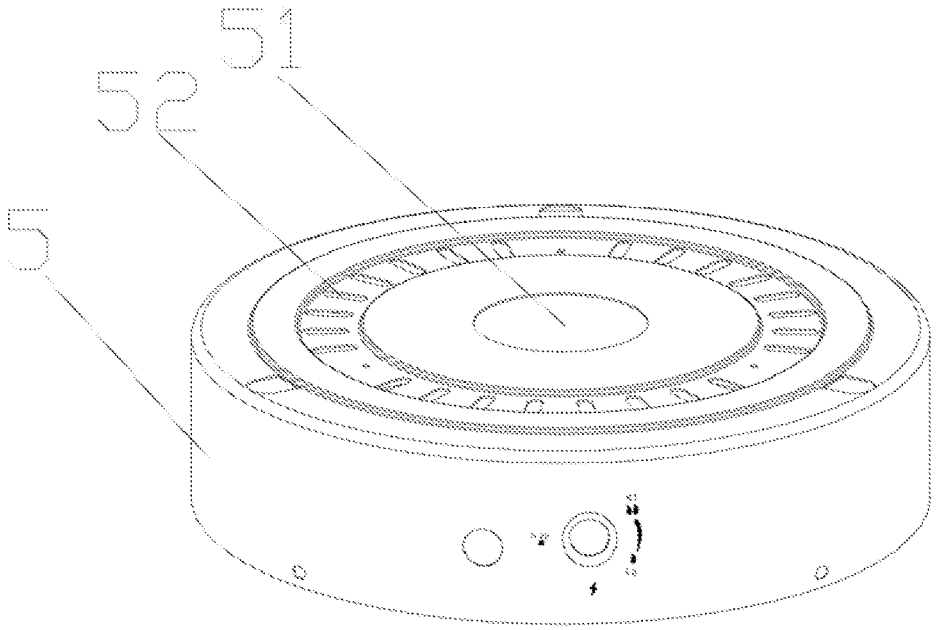
FIG. 5 is a three-dimensional structure diagram of a mounting cap.
Figure 7:
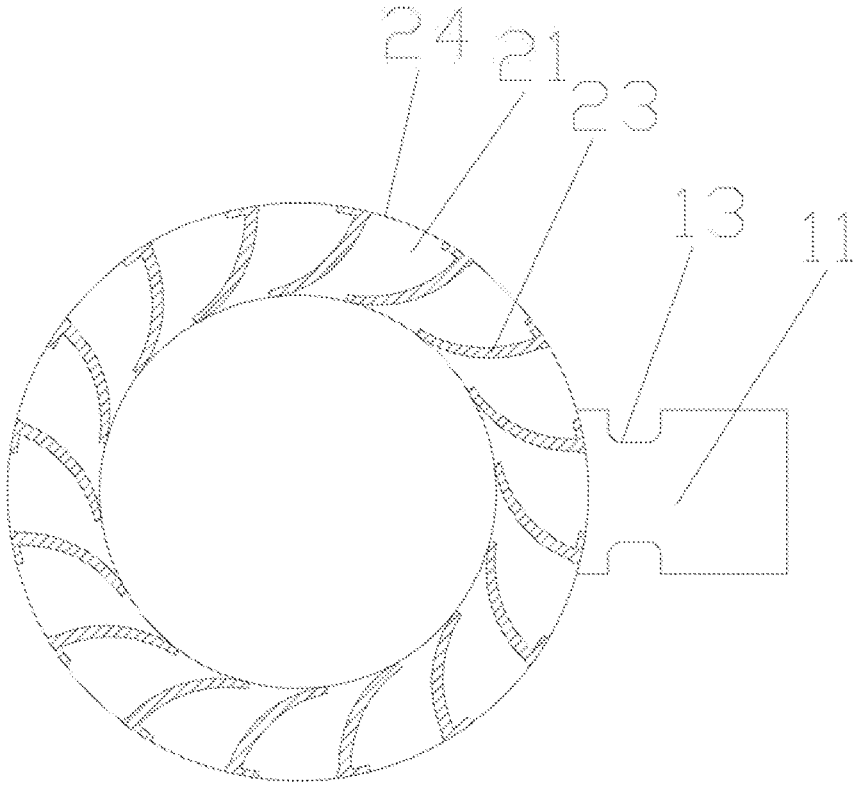
FIG. 7 is a section view along A-A direction of FIG. 6.
Figure 8:
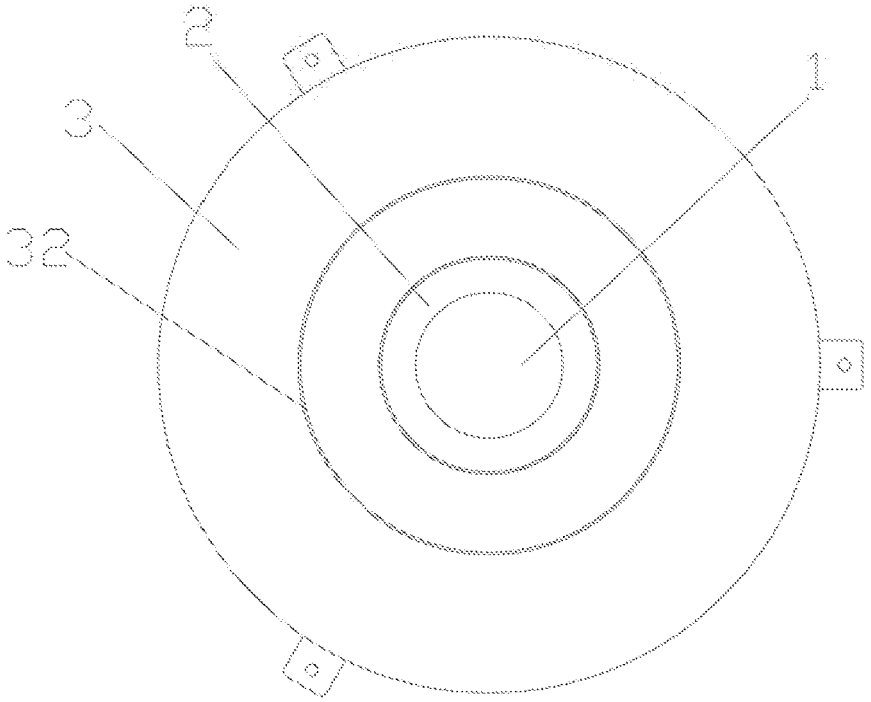
FIG. 8 is a mounting structure top view of the heater (without the mounting cap and glass tube)

As shown in FIGS. 4, 6 and 9, second wind wheel 3 comprises upper mounting plate 34, lower mounting plate 36, and a plurality of second blades 35 set between upper mounting plate 34 and lower mounting plate 36. An interval between each two adjacent second blades 35 forms a second air inlet passage 31. An outward of upper mourning plate 25 is set with second annular baffle 33 extending to the plurality of second air inlet passages 31. As shown in FIG. 7, first blade 23 and second blade 35 stated above are both arc-shaped.

Figure 10:
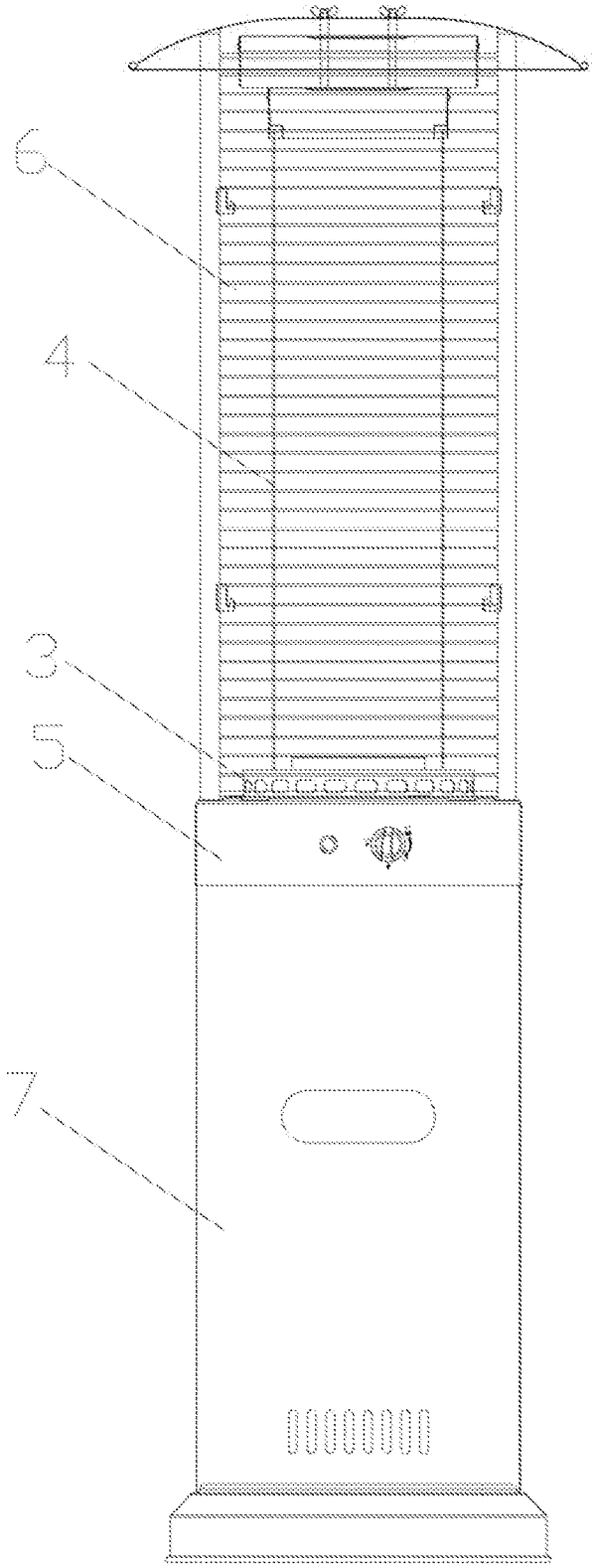
FIG. 10 is a front view of the whole heater (with a protection net and mounting cavity).

As shown in FIG. 4, a top surface of upper mounting plate 34 is set with annular limiting plate 32 projecting from the top surface. An outer diameter of annular limiting plate 32 matches with an inner diameter of glass tube 4. An external of glass tube 4 is set with protection net 6. Glass tube 4 is sleeved on an external of annular limiting plate 32 to fix glass tube 4 effectively. As shown in FIG. 10, protection net 6 set on the external of glass tube 4 can avoid scald by contacting glass tube 4.

The working principle of the present invention is as below: air enters into air inlet pipe 11 through air inlet hole 13 (first air inflow), and then the air mixes with fuel gas in air inlet pipe 11 to form a mixed gas; when the mixed gas enters burner 1, turn on ignition device 12 and generate a long burning fire to ignite the mixed gas in burner 1. Air enters upper part of burner 1 through the plurality of first air passages 21 from the external of first wind wheel 2 to provide air for the mixed gas and provide an initial rotation power for the flame in the upper end of burner 1.

Air enters upward side of first wind wheel 2 (second air inflow) through the plurality of second passages 31 from the external of second wind wheel 3, which further provides air for the fuel gas which does not burning fully, avoids carbon deposition, and changes the trend of the second air inflow at the same time. The second air inflow changes from entering directly into entering, vortically. Because the second air inflow is relatively large and thrust is relatively strong, the flame has a strong thrust when entering a combustor of glass tube 4, which achieves the effect of rotation.

The above-described embodiments are intended to illustrate, rather than limit the disclosure. Variations may be made to the embodiments without departing from the spirit of the disclosure as claimed. The above-described embodiments illustrate the scope of the disclosure, but do not restrict it.

The invention claimed is:

1. A rotary flame heater, comprising a burner, a first wind wheel, a second wind wheel and a glass tube which are set in sequence from bottom to top;

wherein one side of the burner is set with an ignition device, both of the first wind wheel and the second wind wheel are annular, a plurality of first air inlet passages are aslant set on a side wall of the first wind wheel, a plurality of second air inlet passages are aslant set on a side wall of the second wind wheel, an inclined direction of the plurality of first air inlet passages is the same with an inclined direction of second air inlet passages;

wherein a height of the ignition device is the same with a height of the plurality of the first air inlet passages, an inner diameter of the first wind wheel is less than the size of the burner, a bottom of the first wind wheel is fit with a top surface of the burner.

2. The rotary flame heater of claim 1, wherein a side wall of the burner is set with an air inlet pipe connected to the burner, the air inlet pipe is set with an air inlet hole.

3. The rotary flame heater of claim 2, wherein a size of the air inlet hole is 8 mm*20 mm.

4. A rotary flame heater, comprising a burner, a first wind wheel, a second wind wheel and a glass tube which are set in sequence from bottom to top;

wherein one side of the burner is set with an ignition device, both of the first wind wheel and the second wind wheel are annular, a plurality of first air inlet passages are aslant set on a side wall of the first wind wheel, a plurality of second air inlet passages are aslant set on a side wall of the second wind wheel, an inclined direction of the plurality of first air inlet passages is the same with an inclined direction of second air inlet passages;

wherein the first wind wheel comprises an upper dead plate, a lower dead plate and a plurality of first blades set between the upper dead plate and the lower dead plate, an interval between each two adjacent first blades forms a first air inlet passage;

wherein the second wind wheel comprises an upper mounting plate, a lower mounting plate, and a plurality of second blades set between the upper mounting plate and the lower mounting plate, an interval between each two adjacent second blades forms a second air inlet passage.

5. The rotary flame heater of claim 4, wherein the plurality of first blades and the plurality of second blades are both arc-shaped.

6. The rotary flame heater of claim 4, wherein an outward of the upper dead plate is set with a first annular baffle extending to the plurality of first air inlet passages; an outward of the upper mounting plate is set with a second annular baffle extending to the plurality of second air inlet passages.

7. The rotary flame heater of claim 4, wherein a top surface of the upper mounting plate is set with an annular limiting plate projecting from the top surface, an outer diameter of the annular limiting plate matches with an inner diameter of the glass tube, an external of the glass tube is set with a protection net.

8. A rotary flame heater, comprising a burner, a first wind wheel, a second wind wheel and a glass tube which are set in sequence from bottom to top;

wherein one side of the burner is set with an ignition device, both of the first wind wheel and the second wind wheel are annular, a plurality of first air inlet passages are aslant set on a side wall of the first wind wheel, a plurality of second air inlet passages are aslant set on a side wall of the second wind wheel, an inclined direction of the plurality of first air inlet passages is the same with an inclined direction of second air inlet passages;

the rotary flame heater further comprises a mounting cap;

wherein the mounting cap is set with a through-hole in the center, the burner and the first wind wheel are mounted within the mounting, the second wind wheel is mounted on an upper end of the mounting cap, the first wind wheel, the second wind wheel and the through-hole are set co-axially, the mounting cap is set with a plurality of vents connected with external, a bottom of the mounting cap is set with a mounting cavity for mounting a gas source.

9. The rotary flame heater of claim 5, wherein an outward of the tappet dead plate is set with a first annular baffle extending to the plurality of first air inlet passages; an outward of the upper mounting plate is set with a second annular baffle extending to the plurality of second air inlet passages.

* * * * *